US009441465B2

(12) United States Patent
Tassaroli

(10) Patent No.: US 9,441,465 B2
(45) Date of Patent: Sep. 13, 2016

(54) ELECTROMECHANICAL ASSEMBLY FOR CONNECTING A SERIES OF PERFORATING GUNS FOR OIL AND GAS WELLS

(75) Inventor: Carlos Jose Tassaroli, Mendoza (AR)

(73) Assignee: TASSAROLI S.A., Mendoza (AR)

( * ) Notice: Subject to any disclaimer, the term of this patent is extended or adjusted under 35 U.S.C. 154(b) by 1083 days.

(21) Appl. No.: 13/542,722

(22) Filed: Jul. 6, 2012

(65) Prior Publication Data

US 2013/0008639 A1 Jan. 10, 2013

(30) Foreign Application Priority Data

Jul. 8, 2011 (AR) ..... P20110102453

(51) Int. Cl.
*E21B 43/116* (2006.01)

(52) U.S. Cl.
CPC ..... *E21B 43/116* (2013.01)

(58) Field of Classification Search
CPC .. E21B 43/117; E21B 43/116; E21B 43/119; E21B 43/118; E21B 17/046
See application file for complete search history.

(56) References Cited

U.S. PATENT DOCUMENTS 5,026,200 A * 6/1991 van Bilderbeek ..... 403/322.1
2005/0247450 A1* 11/2005 Ratanasirigulchai et al. ..... 166/297
2008/0047716 A1* 2/2008 McKee et al. ..... 166/384

* cited by examiner

*Primary Examiner* — Nicole Coy
*Assistant Examiner* — Kristyn Hall
(74) *Attorney, Agent, or Firm* — Frommer Lawrence & Haug LLP; William S. Frommer

(57) ABSTRACT

Mechanical connector for the connection and assembly of guns used in the perforation of petroleum producing wells. Each gun has a hollow cylindrically shaped housing whose ends have threaded joints. Explosive shipped-charges are radially set in respective peripheral slots of the gun. Guns are coaxially joined in vertical position within the casing of the well, forming an assembly that includes the firing head and a bottom sub. The joints between consecutive guns and between the bottom sub and the lowermost gun, include tubular adaptor pieces and intermediaries that have respectively a threaded joint end and an opposing end constituted by a bayonet-type locking joint formed by a single reinforced latching bayonet locking tab.

5 Claims, 4 Drawing Sheets

ELECTROMECHANICAL ASSEMBLY FOR CONNECTING A SERIES OF PERFORATING GUNS FOR OIL AND GAS WELLS

FIELD OF THE INVENTION

The present invention refers to an electromechanical assembly for connecting a series of guns used in the perforation of petroleum producing wells and more particularly it refers to improvements on the connectors used for assembling the perforating guns.

Perforation of a petroleum producing well consists of the controlled breaking of the metallic casing of the well, the isolating cement surrounding the casing, and the layers of rock in the productive formation by use of explosives housed within perforating-guns; achieving, through bore holes produced by shaped charges, a connection between the depths of the producing zone and the interior of the well.

BACKGROUND OF THE INVENTION

The perforation of petroleum producing wells is realized by lowering into the well various metallic perforating-guns of different lengths, whose respective charge carriers are charged with shaped charges, connected by joints and fired in a vertical fashion, one after another, resulting in a single unit of joined perforating-guns for the perforation of various zones, in a single lowering.

The shaped charges are explosives set in such a manner that they concentrate the force of the explosion outward, generating a jet of gas (plasma) at high pressure and temperature, that pulls the metal from the interior of the charge and projects it outward until it arrives at the well formation, with this action the charges produce a perforating effect that is variable in proportion to the potency of the charges.

Perforating guns are detonated one at a time beginning from the bottom and continuing in an upward fashion. After each detonation, the gun assembly is repositioned vertically in such a way that the lowest gun that remains active is located at the desired depth of perforation.

To fulfill the operation so briefly described, while simultaneously respecting existing norms for the manipulation of explosive, highly capable operators are required to connect and assemble the guns and the wellhead, stripping the ends of connecting wires and joining them by twisting the exposed end of the wires together and covering the joint with adhesive electrical-tape, resulting in an artisanal process that requires extreme caution. It should be noted that petroleum production and exploration activities are generally located in areas with hostile climate conditions for the operators; work hours are assigned in accordance to the needs of the operation and may include night and daytime hours with extreme cold or heat, rain or wind, darkness or sunlight; hours are controlled by working against the clock and by penalizing setbacks; to that respect, it is absolutely necessary that the strictest safety norms be followed while handling explosive material; all of these factors together contribute to an increased likelihood that operators may commit errors while wiring or assembling the perforating guns to be introduced into the well.

From the above facts, there exists an obvious need to simplify the operation of putting together and assembling the perforating gun assembly, in other words, simplification of the mechanical assembly and electrical connections of the gun assembly to establish the required firing sequence. The object of the presented invention deals with the means to perform the mechanical connection of the gun assembly.

Currently, perforating guns are connected and assembled using a multitude of diverse connectors that are consecutively tied together via threaded union pieces, or tandems, resulting in an onerous task requiring a variety of accessories and pieces that constitutes a significant difficulty in the connection and assembly of said guns.

SUMMARY OF THE INVENTION

Facing the current state of the techniques on the subject, an improved perforating gun assembly for use in petroleum producing wells is proposed, where each gun takes the form of a hollow tube of highly resistant steel serving as a casing, within which a charge-carrier loaded with shaped-charges, set in radial fashion along the full length of the charge carrier in accordance with the needs of the client. The carrier is a tube with a slightly smaller diameter than that of the interior of the perforating gun. The shaped-charges are in contact with a detonating cord, comprised of a vein filled with explosive granular, that is in contact with an electronic detonator. Each gun is mounted, coupled with other similar guns, in vertical fashion within the casing of the well, forming an assembly, connected to the surface by an electrical connection, by which the guns will be detonated, beginning with the lowest gun that remains active.

According to this invention, the mechanical connection between the consecutive guns and between the bottom sub and bottom gun are comprised of tubular adaptors and tubular intermediates, each of which has, respectively, a threaded end joint, and an opposing end joint that employs a bayonet twist lock, formed by a singular reinforced locking bayonet locking tab. This bayonet-locking feature notably extends the useful life of the connectors when compared to the threaded end joints currently used in the industry.

Also, the design of these connectors reduces the quantity of accessories that are employed, simplifying the connection and assembly of the guns at the well site, creating a more secure system with a longer useful life.

By having the possibility of assembling a majority of the materials and system in the base, one gains the following advantages:

- Large equipment and tools for the assembly of the guns, such as those currently used, is no longer needed.
- Less time is needed in the field for assembly, benefiting the site operator.
- The possibility of system failures is significantly diminished.
- Assembly at the base simplifies and decreases the effort by personnel, due to improved climatic, lighting, and logistical conditions than those found in the field.

BRIEF DESCRIPTION OF THE DRAWINGS

In the attached figures.

In all figures, like reference numbers represent corresponding or substitute elements.

Figure 1:
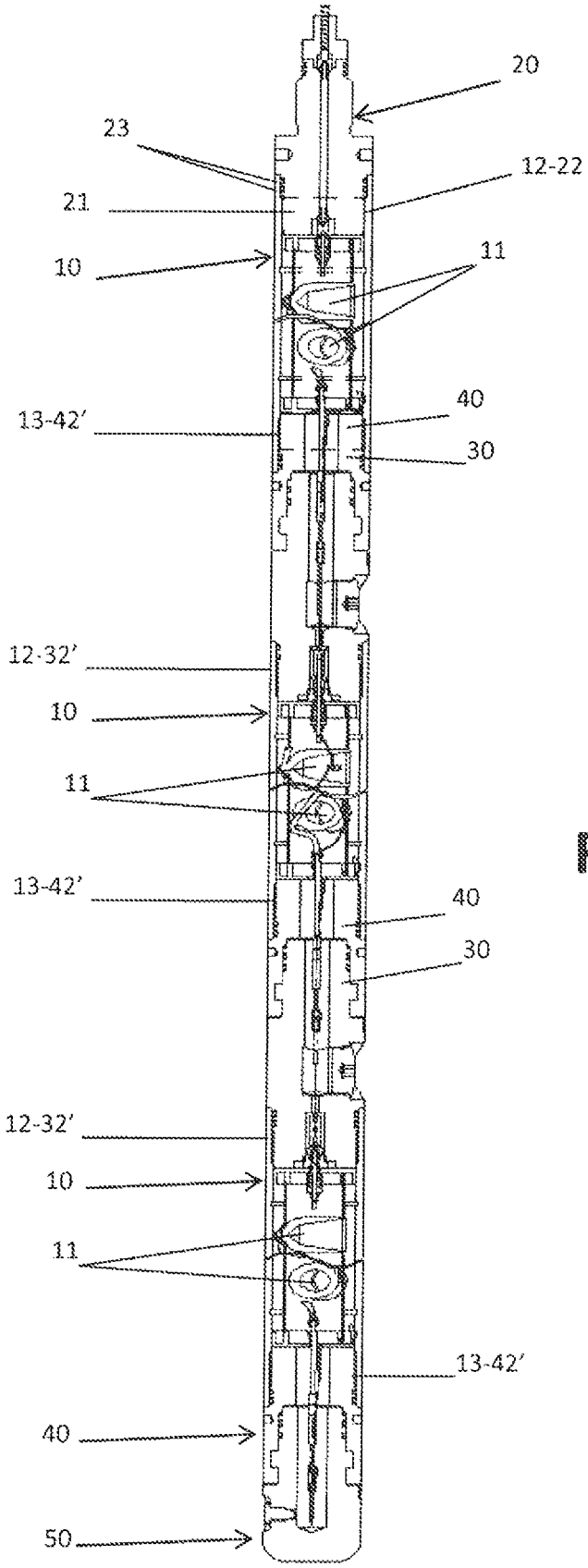
FIG. 1, is a longitudinally dissected schematic showing an assembly of three perforating guns, connected in a selective form using the connectors according to this invention.
Figure 2:
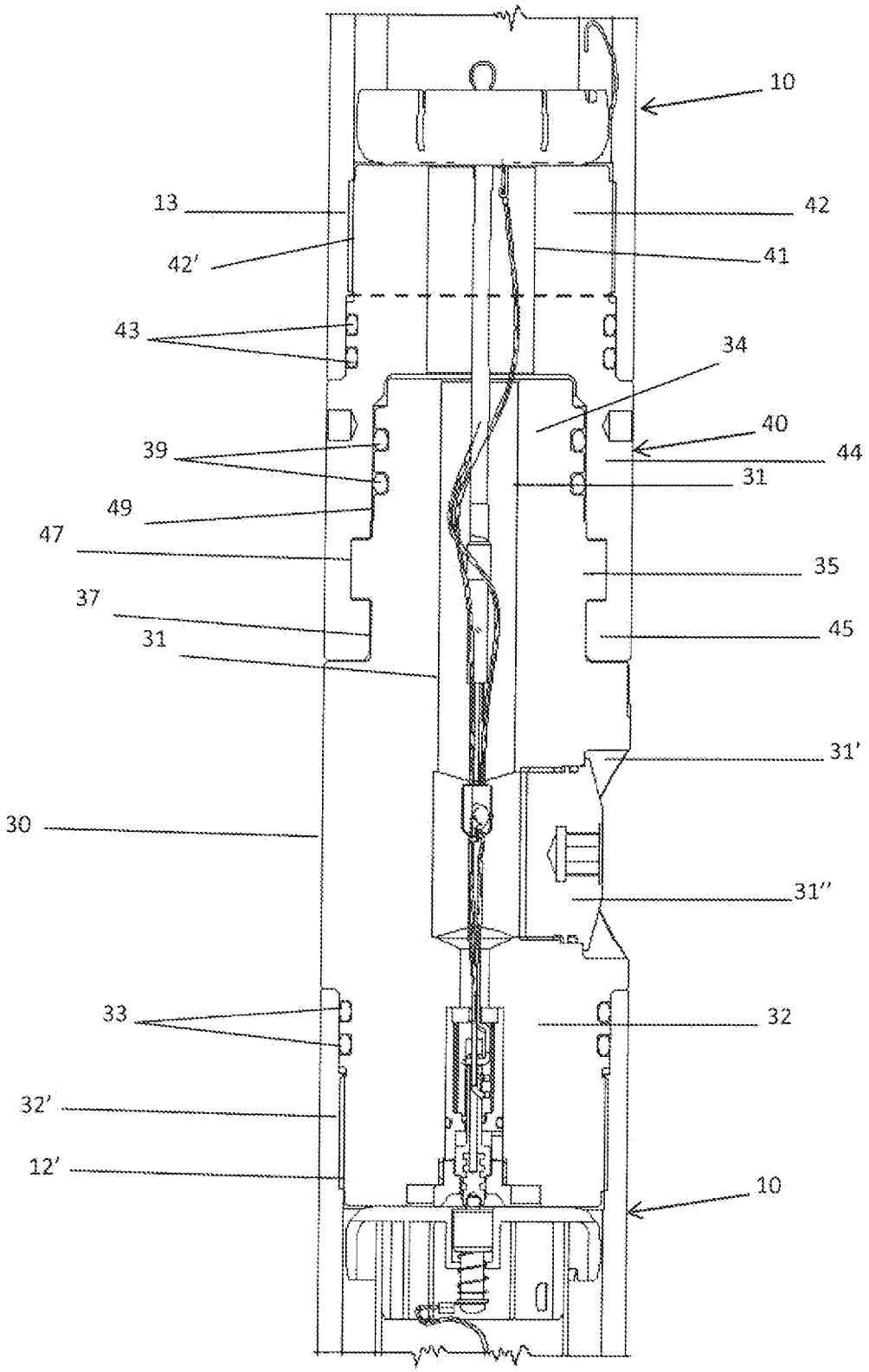
FIG. 2, is a longitudinally dissected schematic of two assembled guns, connected coaxially using a tubular intermediate piece and a tubular adaptor piece.
Figure 3:
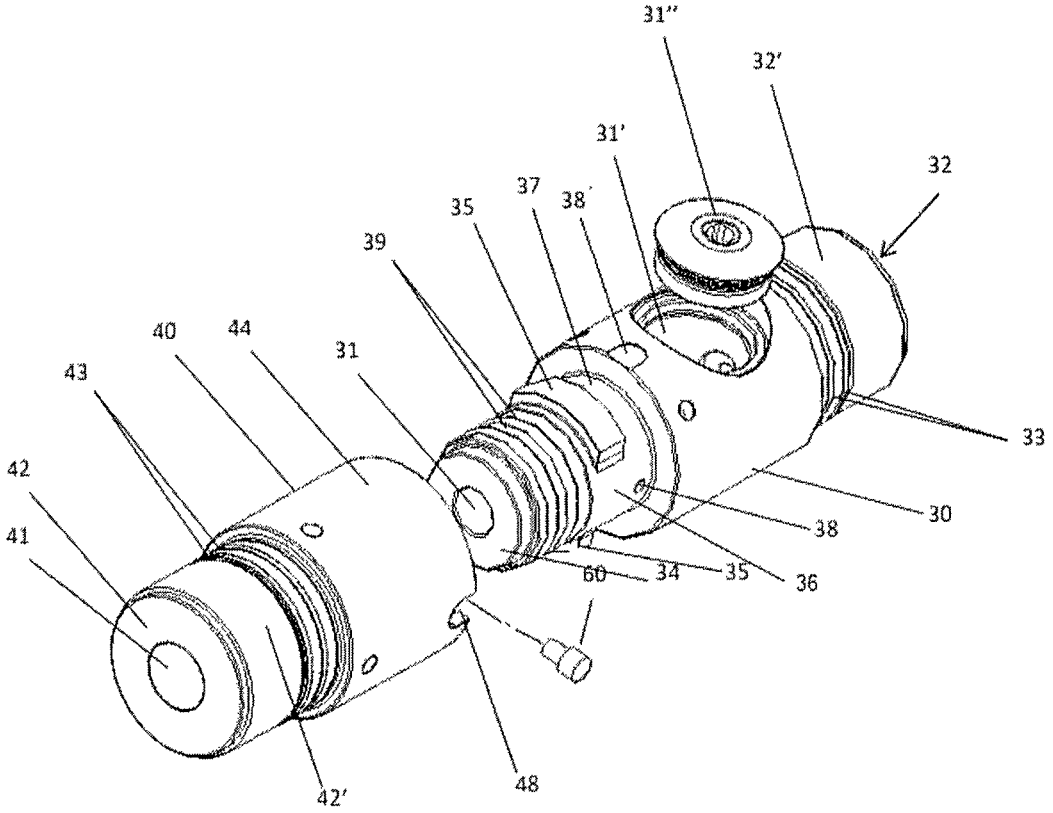
FIG. 3, is a detailed view in projection of a tubular intermediate piece and the corresponding tubular adaptor piece.
Figure 4:
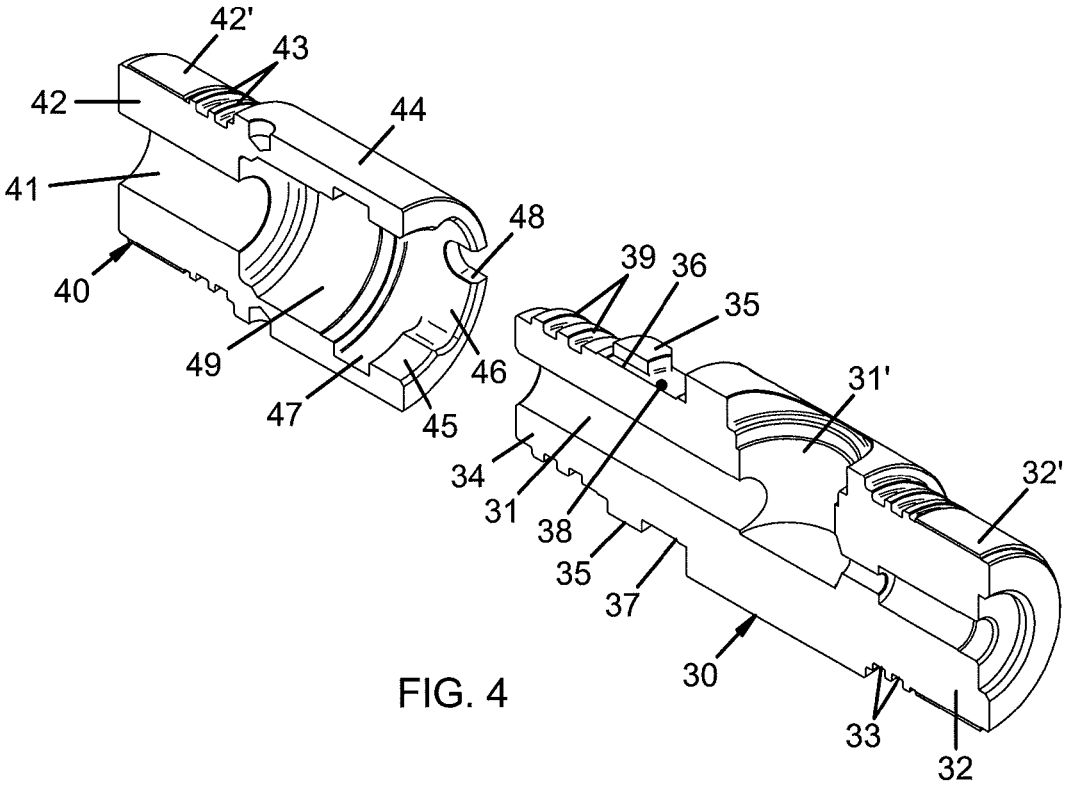
FIG. 4, is a detailed and partially dissected view in projection of said intermediate and adaptor pieces from an opposing perspective.
Figure 5:
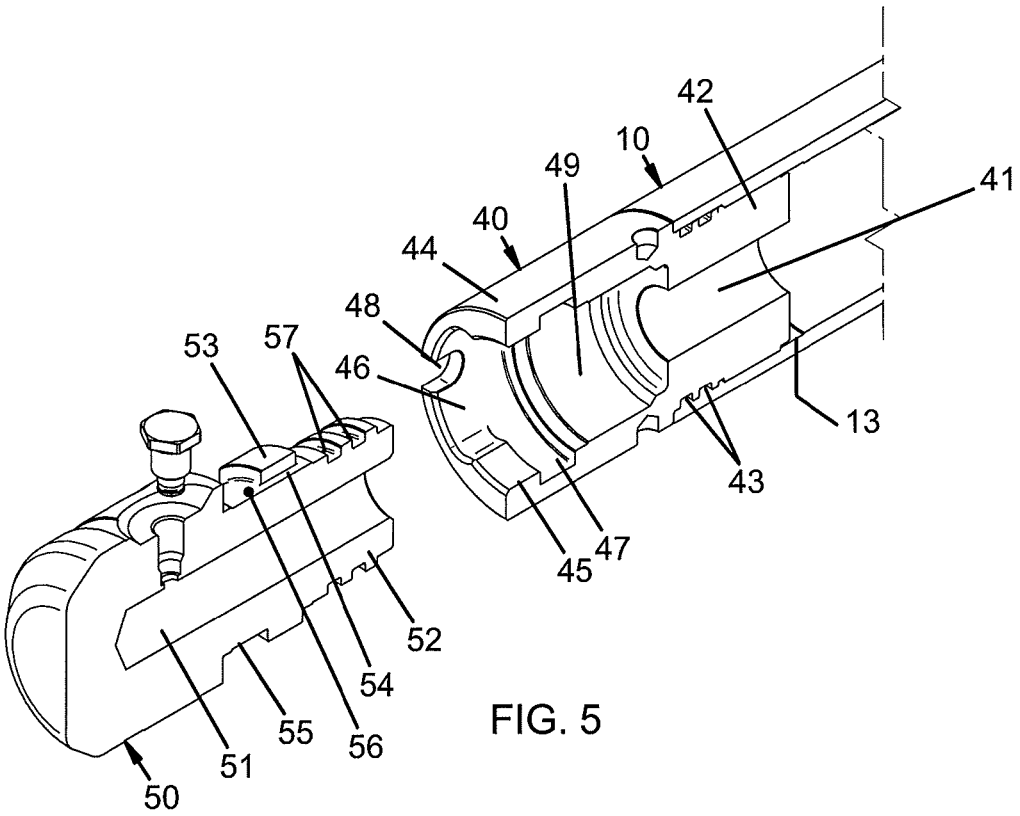
FIG. 5, is another detailed and partially dissected view of the gun having been connected to an adaptor piece and showing the bottom sub separate.

LIST OF MAIN REFERENCES (10) Guns
(11) Explosive shaped-charges
(12-13) Interior of the threaded female end opposite the guns (10)
(20) Firing head
(21) Connecting end of (20)
(22) Threaded male section of (21)
(23) O-ring groove of (21)
(30) Tubular intermediate piece (Tandem)
(31) Axial conduit of (30)
(31') Lateral access opening of (31)
(31") Threaded cap of (31')
(32) Threaded end for connection with (12) and (10)
(32') Threaded portion of (32)
(33) O-ring groove of (32)
(34) Bayonet-Locking end for connection with (40)
(35) Segmented bayonet locking tab of end (34) of (30)
(36) Space between segments of bayonet locking tab (35) for the reciprocal entrance of bayonet locking tab (46)
(37) Annular slot adjacent to the singular segmented bayonet-locking tab (35)
(38) Threaded orifice formed in the bed of (37)
(38') latch indicator.
(39) O-ring groove for (34)
(40) Adapting tubular piece
(41) Axial conduit of (40)
(42) Threaded end for connection with (13) of (10)
(42') Threaded section of (42)
(43) O-ring groove for (42)
(44) Bayonet-Locking end for selectively connecting to (30) or (50)
(45) Segmented bayonet locking tab of female end (45) of (40)
(46) Space between segments of bayonet locking tab (35) for the reciprocal entrance of bayonet locking tab (36) or (53)
(47) Adjacent annular slot of the segmented bayonet-locking tab (46)
(48) Cutout of (44), capable of being selectively positioned with (38) or (56)
(49) Interior surface for the contact with O-ring (39) or (56)
(50) Bottom sub
(51) Blind axial conduit of (50)
(52) Bayonet-Locking end for connection with (40)
(53) Segmented bayonet locking tab of the male assembly (52) of (50)
(54) Space between segments of bayonet locking tab (53) for the reciprocal entrance of bayonet-locking tab (46)
(55) Adjacent annular slot of the segmented bayonet-locking tab (53)
(56) Threaded orifice of (55)
(57) O-ring seal for (52)
(60) Anti-Rotational locking screw

DETAILED DESCRIPTION OF THE INVENTION

The following is a detailed description of exemplary embodiments to illustrate the principles of the invention. The embodiments are provided to illustrate aspects of the invention, but the invention is not limited to any embodiment. As those skilled in the art will appreciate, the scope of the invention encompasses numerous alternatives, modifications and equivalent; it is limited only by the claims.

FIG. 1 illustrates an assembly to be used in the perforation of petroleum producing wells, constituted of three guns (10), a firing head (20), two intermediate pieces (30), three adaptor pieces (40) and a bottom sub (50). The assembly so constituted is the carrier of an electronic circuit for the selective detonation of explosive shaped-charges (11) that are radially positioned in the gun. The constituent elements of said circuit are not described, as they do not form part of the scope of this invention.

Each gun (10) is a hollow treated steel cylinder whose opposing ends contain respective threaded segments (12) and (13). The firing head (20), typically contains an axial orifice for electronically connecting the gun's circuit with a conducting cable (not represented) extending from the surface; similarly, this piece possesses a side (21) to connect with the corresponding gun (10), for this, said extreme (21) has a threaded male terminal (22) corresponding to, threaded female end (12) of the first canon in the series (10). In addition, the end (21) has shaped grooves for O-rings (23) provide a watertight seal between the apparatus and the first gun (10).

Each intermediate piece (30) is comprised of a cylindrical body with an axial borehole (31) for the passage of electrical wiring. The first joining end (32) of the apparatus possesses a threaded male terminal (32') with shaped grooves for O-rings (33) to provide a watertight seal between the apparatus with and corresponding end of said gun (10).

Intermediate piece (30) has a second joining end (34) for connection with the adaptor piece (40), formed by a bayonet-lock with a single reinforced annular bayonet-locking tab. The end (34) has a robust segmented annular bayonet locking tab forming, between the segments (35), separating spaces (36) with length somewhat greater than said bayonet locking tab segments; in the same manner, said segments (35) and spaces (36) are preceded by an annular slot (37), within the end (34). The end also has shaped grooves for O-rings (39) to provide a watertight seal between the connection and the end of the corresponding adaptor (40)

The body (30) contains in the middle a point of access to the axial borehole (31) via lateral opening (31')—a threaded cap (31") is provided for said opening.

Each adaptor (40) possesses a cylindrical body that has an axial borehole (41) for the passage of electrical wiring. This body has two ends. The first end (42) includes a threaded male port (42') for cooperative connection with the threaded female end (13) of the gun (10); additionally, the extreme (42) has shaped grooves for O-rings (43) to provide a watertight seal with said gun (10).

The second end (44) of the adaptor piece (40) includes a female port for connection with the corresponding intermediate piece (30), having elements corresponding to those from the already mentioned bayonet-lock. To that extent, the end (44) has a respective segmented annular bayonet locking tab forming, between segments (45), separating spaces (46) with length somewhat greater than said segments; in the same manner, said segments (45) and spaces (46) are complimented in end (44) by a annular slot (47). In addition, end (44) contains an interior segment (49) to support the O-rings (39) to provide a watertight seal to the male end of the corresponding intermediate (30).

The bottom sub (50) is a cylindrical piece that seals the lower extreme of the series of guns (10), having an end with a blind bore (51) and opposite this sits a male end piece (52)

with elements to allow connection with the adaptor (40). Said end piece (52) contains a segmented annular bayonet locking tab, forming, between the segments (53), separation spaces (54) with length slightly greater than that of said segments. In the same manner, said segments (53) are adjacent to an annular slot (55) integrated into space (54). In addition, the end (52) has shaped grooves for O-rings (57) to provide a watertight seal with the interior section (49) of the corresponding adaptor piece (40).

The spaces (36), (46), and (54) constitute the reciprocal entrance zones of bayonet locking tab segments (35), (45), and (53) of the corresponding intermediate pieces (30), corresponding adaptors (40) and bottom sub (50).

The respective bayonet locking tab segments (35), (45), and (53), are identical; consequently, the corresponding spaces, between bayonet locking tabs (36), (46), and (54) at the entrance into slot (37), (47), and (55) are identical and have a longitudinal expansion somewhat larger than said bayonet locking tabs. Furthermore, the transverse section of said slot (37), (47), and (55) is congruent with the transverse section of the bayonet locking tabs (35), (45), and (53).

Within the wall (44) that forms the end of the female connection of each adaptor (40) exists a cutout (48), so that when the bayonet-locks from pieces (40) and (30) or (50) are connected, said cutout coincides with threaded orifices (38) and (56) in the slot (37) and (55).

In said bayonet-locks, when the male end (34) or (52) is introduced completely into the female end (44) of the corresponding adaptor (40) it should be rotated to anchor the pieces together, which occurs when corresponding bayonet locking tabs (45) and (35) or (45) and (53) from each lock sit one in front of the other. In this rotated position, the cutout (48) coincides with a threaded cutout (38) or (56), allowing the placement of a locking screw (60) that prevents the reciprocal rotation of the two pieces.

Upon the placement of the locking screw (60), said bayonet-locks are incapable of voluntary movement and one avoids the risk of the guns decoupling upon introduction to the well.

The cutout (48) is designed to coincide with one of the spaces (46), preferentially centered between two consecutive bayonet locking tab segments (45) and, in turn, with the threaded orifices (38) and (56) that are each respectively positioned in the slots (37) and (55), equidistantly between the two consecutive bayonet locking tabs (35) or (53). In this manner, the coincidence between the cutout (48) and the threaded orifice (38) or (56), as is required, is only possible when the bayonet locking tabs of the bayonet-lock are juxtaposed in the anchoring position.

What is claimed is:

1. A perforating gun assembly used in the perforation of a petroleum producing well, comprising two or more perforating guns coupled with each other and vertically mounted inside a casing of the petroleum producing well, each perforating gun having a hollow cylindrically shaped housing with threaded joints at both ends;

a firing head connected with one of the perforating guns;

one or more intermediate pieces;

two or more adaptor pieces; and a bottom sub connected with one of the adaptor pieces, wherein each of the intermediate pieces connects one of the perforating guns and one of the adaptor pieces, and each of the adaptor pieces connects one of the perforating guns and the bottom sub or one of the intermediate pieces, and wherein the interior of each perforating gun contains a charge-carrier that holds explosive shaped-charges, the charge-carrier being a tubular piece and having a diameter which is smaller than an inner diameter of the hollow cylindrically shaped housing, and the explosive shaped-charges being radially set in respective peripheral slots of each perforating gun, an electrical cable extending from a surface of the perforating gun is connected to the firing head or the bottom sub and carries an electrical signal to detonate the charge-carrier in each perforating gun, a joint between two consecutive perforating guns includes a threaded joint at a first end, and a bayonet locking joint including a bayonet locking tab at a second end, the bayonet locking joint including a latch indicator and an anti-rotational locking arrangement.

2. The perforating gun assembly of claim 1, wherein a first end of each of the intermediate pieces is connected to the perforating gun by an intermediate piece threaded joint of the intermediate piece, and a second end of each of the intermediate pieces is connected to the adaptor pieces by the bayonet locking joint including a single annular reinforced intermediate piece bayonet locking tab, and wherein a first end of each of the adaptor pieces is connected to the perforating gun by an adaptor piece threaded joint of the adaptor piece, and a second end of each of the adaptor pieces is connected to the bottom sub or the intermediate piece by the bayonet locking joint including a single annular reinforced adaptor piece bayonet locking tab.

3. The perforating gun assembly of claim 1, further comprising an annular sealing element is connected to at least one end of each of the intermediate pieces and the adaptor pieces.

4. The perforating gun assembly of claim 1, wherein each bayonet locking joint includes a male connection part and a female connection part, and wherein the male connection part includes a male connection part bayonet locking tab and a space greater than the male connection part bayonet locking tab in a longitudinal direction and the female connection part includes a female connection part bayonet locking tab and a space greater than the female connection part bayonet locking tab in a longitudinal direction, and the male connection part includes an annular slot corresponding to the male connection part bayonet locking tab and the female connection part includes an annular slot corresponding to the female connection part bayonet locking tab.

5. The perforating gun assembly of claim 4, wherein the female connection part bayonet locking tab includes locking tab segments, and the female connection part includes a centered frontal cutout between two segments of the female connection part bayonet locking tab, wherein the male connection part locking tab includes locking tab segments, and the male connection part includes a threaded orifice equidistantly located between two consecutive segments of the male connection part bayonet locking tab in the annular slot, the cutout and threaded orifice being indicators of locked positions, and wherein a locking screw is positioned at the cutout so that rotation of the bayonet locking joint is prevented.

* * * * *